US009962761B2

(12) United States Patent
Lim et al.

(10) Patent No.: US 9,962,761 B2
(45) Date of Patent: May 8, 2018

(54) REPLACEABLE PISTON RING FOR DIE CASTING MACHINE PLUNGER

(71) Applicant: United Technologies Corporation, Farmington, CT (US)

(72) Inventors: Yuan Kwang Lim, Singapore (SG); Yan Seng Loh, Singapore (SG); Andrew Tan, Singapore (SG); Yao Hui Chee, Singapore (SG); Shih Han Wong, Singapore (SG); Yee Ling Kwan, Singapore (SG)

(73) Assignee: PRATT & WHITNEY SERVICES PTE LTD., Singapore (SG)

( * ) Notice: Subject to any disclaimer, the term of this patent is extended or adjusted under 35 U.S.C. 154(b) by 0 days. days.

(21) Appl. No.: 15/035,319

(22) PCT Filed: Jul. 29, 2014

(86) PCT No.: PCT/SG2014/000355

§ 371 (c)(1),
(2) Date: May 9, 2016

(87) PCT Pub. No.: WO2015/076748

PCT Pub. Date: May 28, 2015

(65) Prior Publication Data

US 2016/0271686 A1 Sep. 22, 2016

(30) Foreign Application Priority Data

Nov. 25, 2013 (SG) ..... 2013087283

(51) Int. Cl.
*B22D 17/20* (2006.01)

(52) U.S. Cl.
CPC ..... *B22D 17/203* (2013.01); *B22D 17/2023* (2013.01)

(58) Field of Classification Search
CPC ..... B22D 17/203; B22D 17/2023
See application file for complete search history.

(56) References Cited

U.S. PATENT DOCUMENTS 3,532,561 A 10/1970 Barto et al.
4,036,113 A 7/1977 Kunz
(Continued)

FOREIGN PATENT DOCUMENTS

EP 0344042 11/1989
EP 2631862 12/1989
(Continued)

OTHER PUBLICATIONS

English Machine Translation of Kim (KR20020045177, which is also published as KR100395799 (B1)).*
(Continued)

*Primary Examiner* — Kevin P Kerns
*Assistant Examiner* — Steven S Ha
(74) *Attorney, Agent, or Firm* — Carlson, Gaskey & Olds, P.C.

(57) ABSTRACT

A plunger assembly for a die casting machine shot sleeve includes a plunger body that has an outer diameter. The plunger includes a head that provides a wall. A piston ring is arranged on the plunger body adjacent to the wall. A nut is secured to the outer diameter and urges the piston ring toward the wall to retain the piston ring securely on the plunger body.

6 Claims, 1 Drawing Sheet

(56) References Cited

U.S. PATENT DOCUMENTS

| | | | | |
|---|---|---|---|---|
| 4,842,039 | A | 6/1989 | Kelm | |
| 4,886,107 | A | 12/1989 | Zecman | |
| 5,954,116 | A | 9/1999 | Jung | |
| 6,311,761 | B1 | 11/2001 | Steininger et al. | |
| 2002/0043356 | A1* | 4/2002 | Schwenecke ..... | B22D 11/055 164/418 |
| 2003/0051854 | A1 | 3/2003 | Guha et al. | |
| 2013/0284018 | A1 | 10/2013 | Tennar | |

FOREIGN PATENT DOCUMENTS

| | | |
|---|---|---|
| EP | 1607154 | 12/2005 |
| FR | 956177 | 3/1944 |
| JP | 5515662 | 12/1980 |
| JP | S55156662 | 12/1980 |
| JP | 06179064 | 6/1989 |
| JP | H06179064 | 6/1994 |
| JP | 09327756 | 12/1997 |
| JP | H09327756 | 12/1997 |
| JP | 10137913 | 5/1998 |
| JP | H10137913 | 5/1998 |
| KR | 20020045177 | 6/2002 |
| WO | 2008123009 | 10/2008 |
| WO | 2011030025 | 3/2011 |

OTHER PUBLICATIONS

English Machine Translation of Kawai (JP-H10-137913).*
International Preliminary Report on Patentability for PCT Application No. PCT/SG2014/000355, dated Jun. 9, 2016.
International Search Report for International Application No. PCT/SG2014/000355 filed Jul. 29, 2014.
Extended European Search Report for European Application No. 14864696.1 dated Nov. 21, 2016.
Thomson Scientific London GB AN 1986-324732 XP002764025 Apr. 23, 1986.

* cited by examiner

REPLACEABLE PISTON RING FOR DIE CASTING MACHINE PLUNGER

BACKGROUND

This disclosure relates to a die casting machine plunger and, more particularly, to a replaceable piston ring for the plunger.

A typical die casting machine includes a plunger that is axially moveable within a shot sleeve to force a shot of molten metal into a die. The plunger is moved in response to an actuator via a rod coupled to the plunger. The outer surface of the plunger is subject to wear as it rides along the inner diameter of the shot sleeve during harsh casting conditions. Typically, the plunger is of a one piece design, requiring the entire plunger to be replaced once worn.

Several multi-piece plungers have been proposed in which an outer piston ring is mounted onto a plunger body. In one example, the piston ring is constructed from a copper material that is replaceable. In the prior art configurations, a structure is secured to the plunger body to retain the piston ring. One end of the piston ring abuts a plunger wall, and the structure abuts the opposing end of the piston ring. In one arrangement, the structure is provided by the rod. In another arrangement, the structure is directly coupled to the rod.

Since the structure is loaded directly or indirectly by the rod, and the force on the rod varies throughout the casting operation, the ability of the structure to retain the piston ring on the plunger body may be compromised.

SUMMARY

In one exemplary embodiment, a plunger assembly for a die casting machine shot sleeve includes a plunger body that has an outer diameter. The plunger includes a head that provides a wall. A piston ring is arranged on the plunger body adjacent to the wall. A nut is secured to the outer diameter and urges the piston ring toward the wall to retain the piston ring securely on the plunger body.

In a further embodiment of the above, the plunger body extends along an axis. The wall is perpendicular to the axis. The piston ring abuts the wall.

In a further embodiment of any of the above, the piston ring includes an unthreaded inner diameter in an interference fit with the outer diameter.

In a further embodiment of any of the above, the piston ring includes a threaded inner diameter in threaded engagement with the outer diameter.

In a further embodiment of any of the above, a spring element provided axially between the piston ring and the nut.

In a further embodiment of any of the above, the spring element includes at least one Belleville washer.

In a further embodiment of any of the above, a rod is secured to the outer diameter. The rod is axially spaced from the nut to provide an axial gap between the rod and the nut.

In another exemplary embodiment, a plunger assembly for a die casting machine shot sleeve includes a plunger body having an outer diameter. The plunger includes a head that provides a wall. A piston ring is secured to the plunger body adjacent to the wall. A rod is secured to the outer diameter. The rod is axially spaced from the piston ring to provide an axial gap between the rod and the piston ring.

In a further embodiment of the above, the plunger body extends along an axis. The wall is perpendicular to the axis. The piston ring abuts the wall.

In a further embodiment of any of the above, a nut is secured to the outer diameter and urges the piston ring toward the wall to retain the piston ring securely on the plunger body.

In a further embodiment of any of the above, a spring element is provided axially between the piston ring and the nut.

In a further embodiment of any of the above, the spring element includes at least one Belleville washer.

In a further embodiment of any of the above, the piston ring includes an unthreaded inner diameter in an interference fit with the outer diameter.

In a further embodiment of any of the above, the piston ring includes a threaded inner diameter in threaded engagement with the outer diameter.

In another exemplary embodiment, a plunger assembly for a die casting machine shot sleeve includes a plunger body having an outer diameter. The plunger includes a head that provides a wall. A piston ring is arranged on the plunger body adjacent to the wall. A nut is secured to the outer diameter and urges the piston ring toward the wall to retain the piston ring securely on the plunger body. A spring element is provided axially between and in engagement with the piston ring and the nut.

In a further embodiment of the above, the plunger body extends along an axis. The wall is perpendicular to the axis. The piston ring abuts the wall.

In a further embodiment of any of the above, the piston ring includes an unthreaded inner diameter in an interference fit with the outer diameter.

In a further embodiment of any of the above, the piston ring includes a threaded inner diameter in threaded engagement with the outer diameter.

In a further embodiment of any of the above, the spring element includes at least one Belleville washer.

In a further embodiment of any of the above, a rod is secured to the outer diameter. The rod is axially spaced from the nut to provide an axial gap between the rod and the nut.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
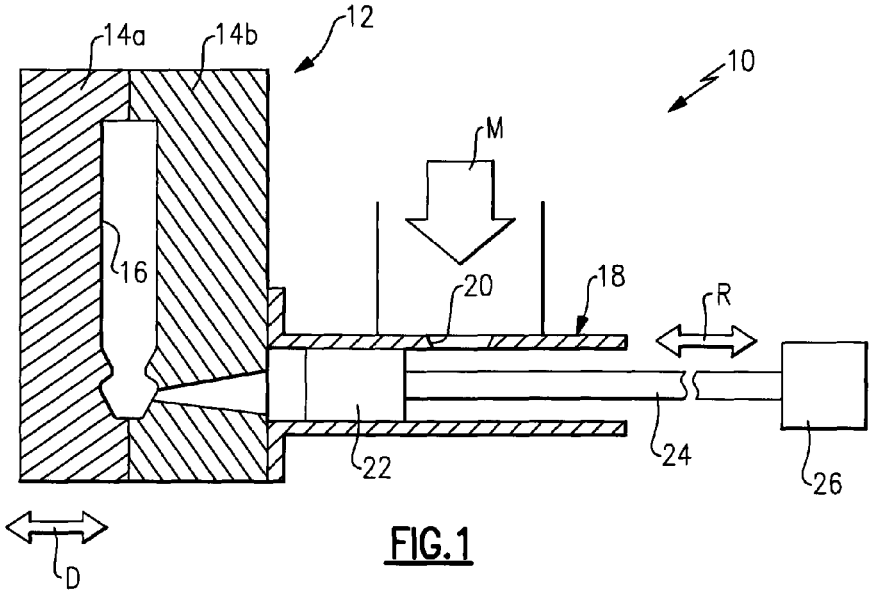
FIG. 1 is a schematic view of an example die casting machine.

A die casting machine 10 is schematically illustrated in FIG. 1. The machine 10 includes a die 12 having multiple die portions 14A, 14B that cooperate with one another to provide a part shape 16. The die 12 is exemplary only and may have any suitable configuration depending on the application.

A shot sleeve 18 is in fluid communication with the die 12 to force molten metal into the die 12 during the die casting process. The shot sleeve 18 includes a pour opening 20 that receives molten material M. A plunger 22 is retracted by an actuator 26 via a rod 24 such that molten metal may be received in an area in the shot sleeve 18 immediately beneath the pour opening 20 and left of the retracted plunger 22. The plunger 22 is moved axially along a plunger axis R to the position illustrated in FIG. 1 to force the molten metal into the die 12. Once the molten metal has sufficiently solidified within the die 12, the die portions 14A, 14B are separated in the direction D.

Figure 2:
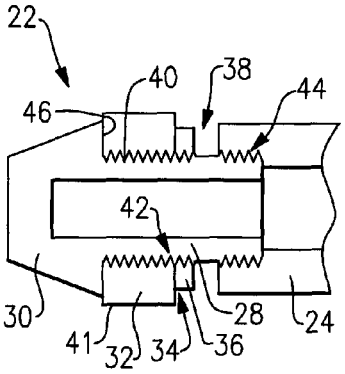
FIG. 2 is a schematic view of an example plunger assembly with a piston ring threaded onto a plunger body.

In the disclosed example, the plunger 22 is provided by an assembly, as illustrated in the example shown in FIG. 2. The plunger 22 includes a plunger body 28 having a head 30 that provides a wall 46. The head 30 is used to force the molten metal into the die 12. In one example, the wall 46 is perpendicular to the plunger body 28. A piston ring 32 is secured to the plunger body 28 and is in abutment with the wall 46. The piston ring 32 provides an outer surface 41 that rides along the inner diameter of the shot sleeve 18.

Figure 4:
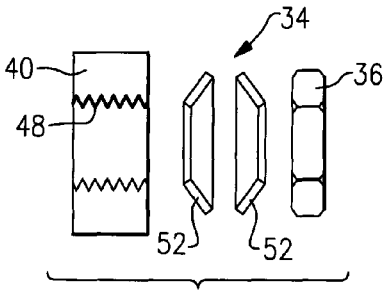
FIG. 4 is an exploded view of the piston ring, a spring element and a nut used to secure the piston ring to the underbody, as shown in FIG. 2.

In the example shown, the plunger body 28 includes an outer diameter 40 that provides first and second threaded surfaces 42, 44. The piston ring 32 is secured to the first threaded surface 42, and a nut 36 is secured to the first threaded surface opposite the head 30. The nut 36 acts as a jam nut and provides an additional securing feature for maintaining the piston ring 32 in engagement with the wall 46. A spring element 34 may be arranged axially between the piston ring 32 and the nut 36 as shown. As shown in FIG. 4, the spring element 34 may be provided by multiple spring elements, such as Belleville washers 52. Any number and orientation of washers may be used.

The rod 24 is secured to the second threaded surface 42 and is axially spaced from the nut 36 to provide an axial gap 38. In this manner, loads transmitted to the rod 24 during casting are isolated from the piston ring 32 and will not permit the piston ring 32 to loosen from the plunger body 28.

Figure 3:
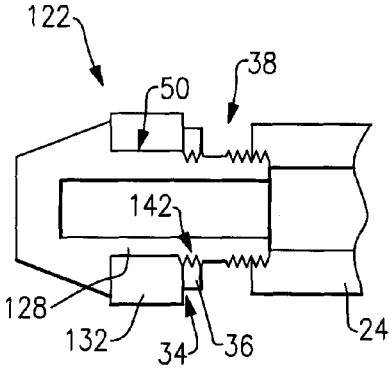
FIG. 3 is another example of a plunger assembly with the piston ring press-fit onto the plunger body.

Another example plunger 122 is illustrated in FIG. 3. In this example, the piston ring 132 is interference or press-fit (e.g., by shrink fitting) onto the outer diameter 50 of the plunger body 128. The spring element 34 and nut 36 additionally secure the piston ring 132 to the plunger body 128 at the first threaded surface 142. The rod 24 is axially spaced from the nut 36 to provide the axial gap 38.

The plunger 22 is reusable. The piston ring 32 can be constructed from the same material or a different material than the plunger body 28. The piston ring 32 bears the bulk of the damage during die casting as it constantly rubs against the inner diameter of the shot sleeve 18. A preassembled plunger assembly can be secured to the rod 24 with the piston ring 32 fully assembled to the plunger body 28, which enables new plunger assemblies to quickly replace worn plunger assemblies during maintenance.

The plunger body 28 can be constructed from an expensive high temperature metal, for example, tungsten, tantalum or other materials, for interfacing with the hot molten metal so as to withstand the thermal shock. The piston ring 32 can be fabricated from a cheaper, low-cost steel alloy, which experiences significantly lower temperatures and higher wear. Alternatively, a low coefficient of friction material, for example, lubricious ceramic, such as $Si_3N_4$, can be used for the piston ring 32 to reduce wear.

The plunger assembly is more resistant to undesirable loosening of the piston ring during casting by isolating the piston ring from the rod. Retention of the piston ring on the plunger body is enhanced by using a jam nut and, if desired, a spring element, such as one or more Belleville washers.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A plunger assembly for a die casting machine shot sleeve, the plunger assembly comprising:

a plunger body having an outer diameter, the plunger includes a head that provides a wall;

a piston ring is arranged on the plunger body adjacent to the wall;

a nut is secured to the outer diameter and urges the piston ring toward the wall to retain the piston ring securely on the plunger body; and a rod secured to the outer diameter, the rod includes an end that is axially spaced from the nut on a side of the nut opposite the head to provide an axial gap between the rod and the nut without transferring loads from the rod to the piston ring via the nut.

2. The plunger assembly according to claim 1, wherein the plunger body extends along an axis, the wall is perpendicular to the axis, and the piston ring abuts the wall.

3. The plunger assembly according to claim 1, wherein the piston ring includes an unthreaded inner diameter in an interference fit with the outer diameter.

4. The plunger assembly according to claim 1, wherein the piston ring includes a threaded inner diameter in threaded engagement with the outer diameter.

5. The plunger assembly according to claim 1, comprising a spring element provided axially between the piston ring and the nut.

6. The plunger assembly according to claim 5, wherein the spring element includes at least one Belleville washer.

* * * * *